US011064286B1

(12) United States Patent
Chen et al.

(10) Patent No.: US 11,064,286 B1
(45) Date of Patent: Jul. 13, 2021

(54) VIBRATOR APPARATUS AND ELECTRONIC DEVICE HAVING THE SAME

(71) Applicant: BEIJING XIAOMI MOBILE SOFTWARE CO., LTD., Beijing (CN)

(72) Inventors: Jing Chen, Beijing (CN); Jianglin Gu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/931,190

(22) Filed: Jul. 16, 2020

(30) Foreign Application Priority Data

Feb. 27, 2020 (CN) ..... 202010125988.X

(51) Int. Cl.

| | |
|---|---|
| ***H04R 1/02*** | (2006.01) |
| ***H04R 1/24*** | (2006.01) |
| ***H04R 17/00*** | (2006.01) |
| ***H04R 3/12*** | (2006.01) |

(52) U.S. Cl.
CPC ..... *H04R 1/24* (2013.01); *H04R 1/028* (2013.01); *H04R 3/12* (2013.01); *H04R 17/00* (2013.01); *H04R 2499/11* (2013.01); *H04R 2499/15* (2013.01)

(58) Field of Classification Search
CPC ..... H04R 1/02
See application file for complete search history.

(56) References Cited

U.S. PATENT DOCUMENTS

| | | | | |
|---|---|---|---|---|
| 10,671,114 | B2 * | 6/2020 | Ahn | H04R 1/025 |
| 10,877,585 | B2 * | 12/2020 | Noh | G06F 3/0446 |
| 2012/0140969 | A1 | 6/2012 | Fujise et al. | |
| 2012/0243719 | A1 * | 9/2012 | Franklin | H04R 1/02 381/333 |
| 2019/0297420 | A1 | 9/2019 | Harris | |

OTHER PUBLICATIONS

Extended European Search Report issued in European Application No. 20188271.9 dated Dec. 10, 2020, (9p).

* cited by examiner

*Primary Examiner* — Olisa Anwah
(74) *Attorney, Agent, or Firm* — Arch & Lake LLP

(57) ABSTRACT

The present disclosure provides a vibrator apparatus and an electronic device. The vibrator apparatus is fixed in the body of the electronic device. The vibrator apparatus includes a plurality of vibrators separately disposed in the body and configured to vibrate to generate sound, and the vibrator includes a bonding face configured to be bonded to the body. Two or more vibrators of the plurality of vibrators have at least one of the following different qualities: thicknesses, different areas of the bonding faces and different shapes of the bonding faces. The thickness of the vibrator is a dimension measured along a direction perpendicular to the bonding face.

18 Claims, 7 Drawing Sheets

VIBRATOR APPARATUS AND ELECTRONIC DEVICE HAVING THE SAME

CROSS-REFERENCE TO RELATED APPLICATION

This application is based on and claims priority to Chinese Patent Application Serial No. 202010125988.X, filed on Feb. 27, 2020, the entire content of which is incorporated herein by reference for all purposes.

TECHNICAL FIELD

The present disclosure relates to a field of electronic devices, and more particularly to a vibrator apparatus and an electronic device including the vibrator apparatus.

BACKGROUND

With the development of science and technology, a holeless electronic device with a full screen has become a mainstream of development, which needs to cancel a structure of a sound output hole arranged on the same face with a display screen, thus promoting the development of sound generation technology. Taking the sound generation technology by a screen as an example, a vibrator is fixed to the display screen and drives the display screen to vibrate to generate sound. In this way, a loudspeaker of the electronic device is replaced and the structure of the sound output hole is cancelled, which is conductive to the full screen of the electronic device and the holeless electronic device. However, a sound pressure level of a frequency response curve of the vibrator is not balanced at low and high frequencies, which is not conducive to ensuring a sound quality of the electronic device.

SUMMARY

The present disclosure provides an improved vibrator apparatus and an electronic device.

A first aspect of the present disclosure provides a vibrator apparatus for an electronic device. The vibrator apparatus includes a plurality of vibrators, where the vibrator apparatus is fixed in a body of the electronic device, the plurality of vibrators are separately disposed in the body and configured to vibrate to generate sound. Each of the plurality of vibrators comprises a bonding face configured to be bonded to the body. Two or more vibrators of the plurality of vibrators have at least one of the following different qualities: thicknesses, different areas of the bonding face or different shapes of the bonding face. The thickness of each of the plurality of vibrators is measured along a direction perpendicular to the bonding face.

A second aspect of the present disclosure provides an electronic device, and the electronic device includes a body and a vibrator apparatus fixed in the body. The vibrator apparatus includes a plurality of vibrators separately disposed in the body and configured to vibrate to generate sound. Each of the plurality of vibrators comprises a bonding face configured to be bonded to the body. Two or more vibrators of the plurality of vibrators have at least one of the following different qualities: thicknesses, different areas of the bonding face or different shapes of the bonding face. The thickness of each of the plurality of vibrators is measured along a direction perpendicular to the bonding face.

It should be understood that the above general description and the detailed description below are merely used to explain the present disclosure, and cannot be construed as a limitation to the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

Figure 1:
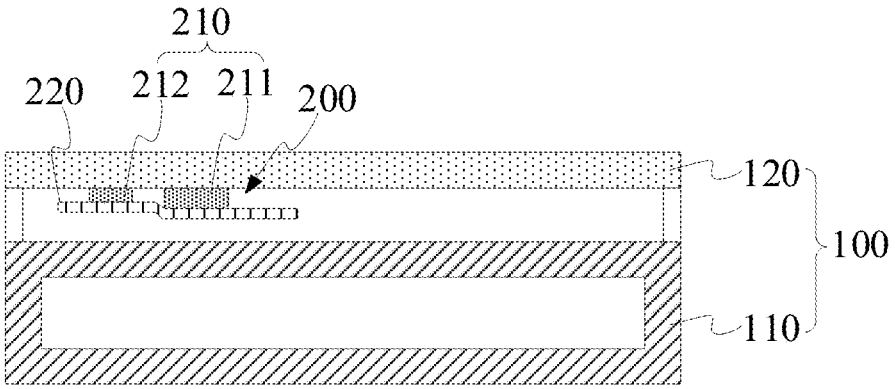
FIG. 1 illustrates a schematic view of a partial structure of an electronic device according to an illustrative example of the present disclosure.

Reference will now be made in detail to illustrative examples with the accompanying drawings. The following description refers to the accompanying drawings in which the same numbers in different drawings represent the same or similar elements unless otherwise represented. The implementations set forth in the following description of illustrative examples do not represent all implementations consistent with the present disclosure. Instead, they are merely examples of apparatuses and methods consistent with aspects related to the present disclosure as recited in the appended claims.

The terms used in the present disclosure are merely for the purpose of describing specific examples, which are not intended to limit the present disclosure. Unless defined otherwise, the technical or scientific terminologies used in the present disclosure shall be the general meaning understood by those skilled in the related art of the present disclosure. Terms such as "first", "second" or the like used in the descriptions and claims of the present disclosure do not indicate any order, quantity or importance, but are only used to distinguish different components. Similarly, terms such as "one" or "a" do not refer to quantity limitation, but indicate the existence of at least one. Unless specified otherwise, terms such as "comprise", "include" or the like mean that the elements or objects presented before "comprise" or "include" contain the elements or objects and their equivalents presented after "comprise" or "include", while other elements or objects are not excluded. The terms "interconnect", "connected" or the like are not restricted to physical or mechanical connections, but may also be electrical connections, no matter direct or indirect.

As used in the descriptions and the appended claims of the present disclosure, "a" and "the" in singular forms mean including plural forms, unless clearly indicated in the context otherwise. It should also be understood that, as used herein, the term "and/or" represents and contains any and all possible combinations of one or more associated listed items.

In some examples, an electronic device includes a body and a vibrator arranged in the body, and the vibrator is configured to vibrate to generate sound. However, a frequency response curve of the vibrator does not have a balanced sound pressure level at low and high frequencies, which cannot ensure a sound quality and is not conducive to replacing a loudspeaker of the electronic device.

In other examples, an electronic device includes a body and a vibrator apparatus arranged in the body. The vibrator apparatus includes a plurality of identical vibrators in a regular and orderly arrangement. Although the sound pressure level of the frequency response curve of the vibrator apparatus is relatively balanced, so as to solve a problem of the unbalanced sound pressure level in low, medium and high frequencies, the limitation is relatively great. The limitation includes that an arrangement of the plurality of vibrators is not flexible and occupies a large area, and the dimension and number of the plurality of vibrators cannot be designed flexibly, which is not conducive to reducing the power consumption.

In order to solve the above problems, the present disclosure provides a vibrator apparatus and an electronic device, and the vibrator apparatus is fixed in a body of the electronic device. The vibrator apparatus includes at least two vibrators separately disposed in the body, and configured vibrate to generate sound. The vibrator includes a bonding face configured to be bonded to the body. Two or more than two vibrators of the at least two vibrators have at least one of different thicknesses, different areas of the bonding faces and different shapes of the bonding faces. The thickness of the vibrator is a dimension of the vibrator along a direction perpendicular to the bonding face. The electronic device includes the body and the vibrator apparatus fixed in the body.

In the vibrator apparatus and the electronic device according to the example of the present disclosure, the two or more than two vibrators of the at least two vibrators have at least one of following different qualities: thicknesses, areas of the bonding face, or shapes of the bonding face. By means of the cooperation of these vibrators, not only the sound pressure level of the frequency response curve of the vibrator apparatus is balanced and consistent, so as to improve the sound generation effect, but also more possibilities for flexible arrangements of the vibrators are provided, which is conductive to reducing the occupied space, such that the electronic device is highly integrated and the volume of the electronic device is miniaturized. Moreover, compared with a plurality of identical vibrators, the thickness, the area of the bonding face, the shape of the bonding face and/or the number of the vibrators in the examples of the present disclosure can be flexibly designed, which is conductive to reducing the power consumption. The adoption of the vibrator apparatus also facilitates the development of the full screen of the electronic device and the holeless electronic device.

In order to understand the vibrator apparatus and the electronic device provided in the present disclosure more clearly, following detailed descriptions are made with reference to FIGS. 1-9.

The electronic device provided in the examples of the present disclosure includes, but is not limited to, a mobile phone, a tablet computer, an iPad, a digital broadcasting terminal, a message receiving and sending device, a game console, a medical facility, a fitness facility, a personal digital assistant, and other intelligent devices, etc.

FIG. 1 illustrates a partial schematic view of an electronic device according to an illustrative example of the present disclosure. The electronic device includes a body 100, a vibrator apparatus 200 and a controller, and the vibrator apparatus 200 is fixed in the body 100. The vibrator apparatus 200 may drive at least part of the body 100 to vibrate to generate sound, so as to replace a loudspeaker or other sound generators of the electronic device, which is conducive to cancelling a sound output hole of the electronic device and promoting the design of the full screen of the electronic device and the holeless electronic device.

In some examples, the body 100 includes a housing, and the vibrator apparatus 200 is fixed in the housing.

In other examples, as illustrated in FIG. 1, the body 100 includes a housing 110 and a screen display 120 arranged on a front face of the housing 110, a space is formed between the housing 110 and the screen display 120, and the vibrator apparatus 200 is arranged in the space. In some examples, a vibrator 210 of the vibrator apparatus 200 is bonded to a face of the housing 110 facing the screen display 120, and the vibrator apparatus 200 drives the housing 110 to vibrate to generate sound. The housing 110 may include a middle frame, and the vibrator apparatus 200 is fixed to the middle frame.

In other examples, the vibrator 210 of the vibrator apparatus 200 is bonded to a face of the screen display 120 facing the housing 110, and the vibrator apparatus 200 drives the screen display 120 to vibrate to generate sound. Further, when the vibrator 210 is bonded to the screen display 120, a gap may be formed between the vibrator apparatus 200 and the housing 110 to avoid driving the housing 110 to vibrate, thus ensuring the user's comfortable experience of holding the electronic device.

Figure 2:
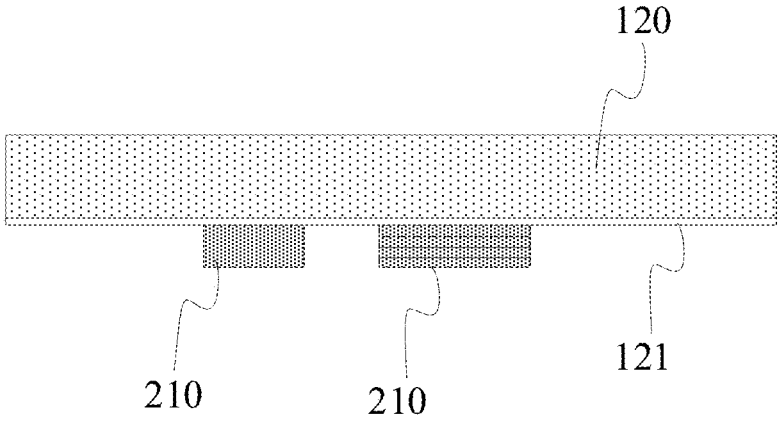
FIG. 2 illustrates a schematic view of a partial structure of an electronic device according to an illustrative example of the present disclosure.

FIG. 2 illustrates a partial schematic view of an electronic device according to an illustrative example of the present disclosure. In some examples, as illustrated in FIG. 2, the face of the display screen 120 facing the housing 110 is provided with a shielding layer 121, and the vibrator 210 of the vibrator apparatus 200 is bonded to a face of the shielding layer 121 facing away from the display screen 120. In this way, the vibrator 210 can be avoided from being directly bonded to the display screen 120 to produce a bonding mark, which otherwise affects the display effect of the display screen 120. In some examples, the shielding layer 121 may be bonded to the display screen 120 through a solid adhesive, a liquid adhesive, a UV adhesive, a pressure-sensitive adhesive or the like with a relatively dark color.

The vibrator apparatus 200 includes at least two vibrators 210 separately disposed in the body 100 and a flexible printed circuit board 220.

Figure 3:
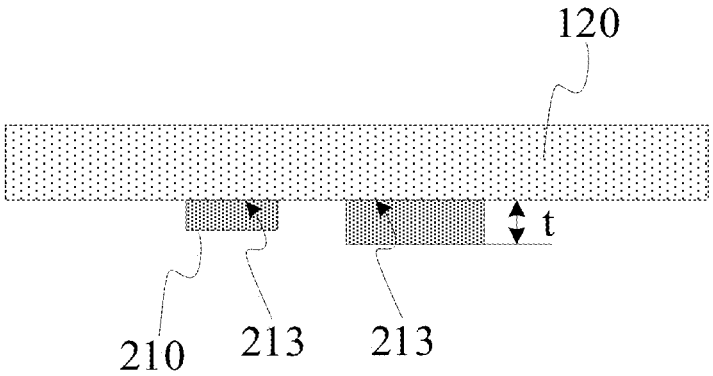
FIG. 3 illustrates an enlarged schematic view of the partial structure of the electronic device in FIG. 1.

FIG. 3 illustrates a partially enlarged schematic view of the electronic device in FIG. 1. The at least two vibrators 210 are configured to vibrate to generate sound. As illustrated in FIG. 3, the vibrator 210 includes a bonding face 213 configured be bonded to the body 100. Two or more than two vibrators 210 of the at least two vibrators 210 have at least one of different thicknesses, different areas of the bonding faces 213, or different shapes of the bonding faces 213. A thickness t of the vibrator 210 is a dimension of the vibrator 210 along a direction perpendicular to the bonding face 213.

It should be noted that, the thicknesses of the two or more than two vibrators 210 of the at least two vibrators 210 are different, or the areas of the bonding faces 213 of the two or more than two vibrators 210 of the at least two vibrators 210 are different, or the shapes of the bonding faces 213 of the two or more than two vibrators 210 of the at least two vibrators 210 are different, or both the thicknesses of the two or more than two vibrators 210 of the at least two vibrators 210 and the areas of the bonding faces 213 of the two or more than two vibrators 210 of the at least two vibrators 210 are different (for instance, the thickness and the area of bonding face 213 of one vibrator 210 are different from the thickness and the area of bonding face 213 of another vibrator 210), or both the thicknesses of the two or more than two vibrators 210 of the at least two vibrators 210 and the shapes of the bonding faces 213 of the two or more than two vibrators 210 of the at least two vibrators 210 are different (for instance, the thickness and the shape of the bonding face 213 of one vibrator 210 are different from the thickness and the shape of the bonding face 213 of another vibrator 210), or both the areas of the bonding faces 213 of the two or more than two vibrators 210 of the at least two vibrators 210 and the shapes of the bonding faces 213 of the two or more than two vibrators 210 of the at least two vibrators 210 are different (for instance, the area and the shape of the bonding face 213 of one vibrator 210 are different from the area and the shape of the bonding face 213 of another vibrator 210), or the thicknesses, the areas of the bonding faces 213 and the shapes of the bonding faces 213 of the two or more than two vibrators 210 of the at least two vibrators 210 are different. Further, some vibrators 210 of the at least two vibrators 210 may have identical thicknesses, identical areas of the bonding faces 213, and/or identical shapes of the bonding faces 213.

In the vibrator apparatus 200 and the electronic device according to the example of the present disclosure, the two or more than two vibrators 210 of the at least two vibrators 210 have at least one of the different thicknesses, the different areas of the bonding faces 213 and the different shapes of the bonding faces 213, such that the vibrator apparatus 200 includes the vibrator 210 having the frequency response curve with an excellent low frequency performance, the vibrator 210 having the frequency response curve with an excellent intermediate frequency performance and the vibrator 210 having the frequency response curve with an excellent high frequency performance. By means of the cooperation of these vibrators 210, not only the sound pressure level of the frequency response curve of the vibrator apparatus 200 is balanced and consistent, so as to improve the sound generation effect of the electronic device, but also more possibilities for flexible arrangements of the vibrator apparatus 200 are provided, which is conductive to reducing the occupied space, such that the electronic device is highly integrated and the volume of the electronic device is miniaturized. Moreover, compared with a plurality of identical vibrators 210, the thickness, the area of the bonding face 213, the shape of the bonding face 213 and/or the number of the vibrators 210 in the examples of the present disclosure can be flexibly designed, which is conductive to reducing the power consumption. The adoption of the vibrator apparatus 200 also facilitates the development of the full screen of the electronic device and the holeless electronic device.

In some examples, the at least two vibrators 210 include at least one of a piezoelectric film and a piezoelectric ceramic. In some examples, the at least two vibrators 210 are the piezoelectric films. In some examples, the at least two vibrators 210 are the piezoelectric ceramics. In some examples, the at least two vibrators 210 include the piezoelectric film and the piezoelectric ceramic. Further, the vibrator 210 may be other exciters, which is not specifically limited in the present disclosure. In some examples, the piezoelectric film is light in weight, soft, and can be easily applied to different spaces within the body 100. Compared with other exciters, the piezoelectric film and the piezoelectric ceramic are more conducive to saving the occupied space.

In some examples, a material of the vibrator 210 includes a piezoelectric material. In some examples, the piezoelectric material includes lead zirconate titanate piezoelectric ceramics (PZT), and polyvinylidene fluoride (PVDF).

The flexible printed circuit board (FPCB) 220 is connected with a face of the vibrator 210 which faces away from the bonding face 213. In some examples, the FPCB 220 is also connected with a controller in the electronic device, and the controller controls the vibrator 210 to operate through the FPCB 220. Moreover, the FPCB 220 may be fitted with spaces of different structures in the body 100, which is conducive to the high integration and the miniaturized volume of the electronic device.

In some examples, the vibrator apparatus 200 also includes an adhesive layer arranged on the bonding face 213, and the adhesive layer is configured to bond the bonding face 213 to the body 100. In some examples, the way that the vibrator 210 is adhered to the body 100 through the adhesive layer is simple and facilitates the production and manufacture of the electronic device. Further, the vibrator 210 may also be fixed to the body 100 in other ways. In some examples, the adhesive layer is formed by a solid adhesive, a liquid adhesive, a UV adhesive, or a pressure-sensitive adhesive.

The controller is connected with the vibrator apparatus 200. Two or more than two vibrators 210 of the at least two vibrators 210 of the vibrator apparatus 200 are controlled to vibrate by the controller, and/or the controller controls the vibrator 210 of the vibrator apparatus 200 to vibrate under at least one driving voltage. In some examples, the controller may control a part of the vibrators 210 to vibrate and other vibrators 210 not to work, and may also control all the vibrators 210 to vibrate. The controller may control the vibrator 210 to vibrate under one driving voltage, and may also control the vibrator 210 to vibrate under a plurality of driving voltages. In this way, it is flexible to control a part of the vibrators 210 to vibrate and adjust the driving voltage based on actual situations, which is not only conductive to the balanced and consistent performance of the frequency response curve of the vibrator apparatus 200, but also conducive to energy saving and consumption reduction.

In some examples, the controller includes an integrated circuit (IC), a plurality of vibrators 210 are connected to the IC in parallel, and the IC may control different vibrators 210 to vibrate with different driving voltages or with identical driving voltage. The plurality of vibrators 210 may also be connected to the IC in series. In other examples, the controller includes a plurality of ICs, and the plurality of ICs are connected to a plurality of vibrators 210 in one to one correspondence. Each IC may control the vibrator 210 connected thereto with a determined driving voltage, and the driving voltages of the plurality of ICs may be identical or different.

In some examples, the vibrator 210 is connected to the IC through at least two metal conductive contacts. When the vibrator apparatus 200 includes the flexible printed circuit board 220, the controller is connected to the vibrator 210 through the flexible printed circuit board 220.

The influences of the area of the bonding face 213, the thickness and the position of the vibrator 210 on the frequency response curve are respectively explained as follows with reference to the drawings.

Figure 4:
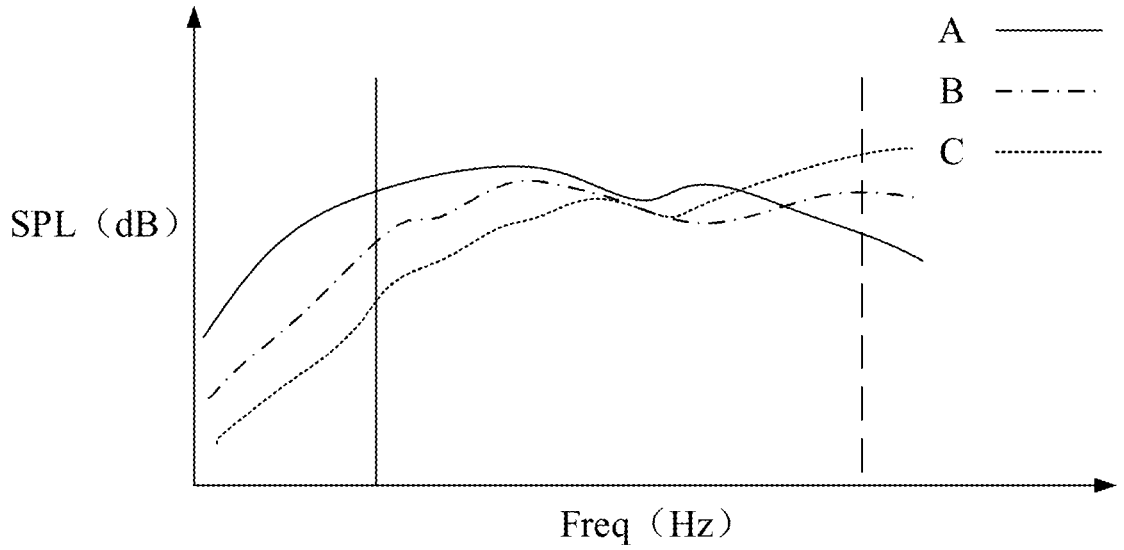
FIG. 4 illustrates a schematic view of frequency response curves of three vibrators with different areas of bonding faces according to an illustrative example of the present disclosure.

FIG. 4 illustrates a schematic view of frequency response curves of three vibrators 210 having the different areas of the bonding faces 213 according to an illustrative example of the present disclosure. In FIG. 4, a horizontal axis (Freq) represents a frequency, and the frequency increases gradually along a direction to which an arrow of the horizontal axis points. A longitudinal axis (SPL) represents a sound pressure level, and the sound pressure level increases gradually along a direction to which an arrow of the longitudinal axis points. A frequency corresponding to a solid straight line is less than a frequency corresponding to a dotted straight line. Three frequency response curves A, B, C are the frequency response curves of Vibrator 1, Vibrator 2, and Vibrator 3, respectively. Vibrator 1, Vibrator 2, and Vibrator 3 have the same structure and thickness, but the area of the bonding face of Vibrator 1>the area of the bonding face of Vibrator 2>the area of the bonding face of Vibrator 3. It can be known from FIG. 4 that, at the solid straight line (i.e. at a relatively low frequency), the sound pressure level of the frequency response curve A>the sound pressure level of the frequency response curve B>the sound pressure level of the frequency response curve C. With the increase of the frequency, the sound pressure level of the frequency response curve A decreases, the sound pressure level of the frequency response curve B and the sound pressure level of the frequency response curve C first decrease and then increase, and the increase amplitude of the sound pressure level of the frequency response curve C is relatively large. At the dotted straight line (i.e. at a relatively high frequency), the sound pressure level of the frequency response curve A<the sound pressure level of the frequency response curve B<the sound pressure level of the frequency response curve C. As can be seen, the larger the area of the bonding face 213 of the vibrator 210 is, the better the low frequency performance of the frequency response curve is, and the smaller the area of the bonding face 213 of the vibrator 210 is, the better the high frequency performance of the frequency response curve is.

In some examples, the at least two vibrators 210 include a first vibrator 211 and at least one second vibrator 212, and the first vibrator 211 and the at least one second vibrator 212 are dispersedly arranged. The area of the bonding face 213 of the first vibrator 211 is larger than that of the second vibrator 212. In some examples, according to the influence of the area of the bonding face 213 on the frequency response curve, the low frequency performance of the frequency response curve of the first vibrator 211 is better than the low frequency performance of the frequency response curve of the second vibrator 211, and the high frequency performance of the frequency response curve of the second vibrator 212 is better than the high frequency performance of the frequency response curve of the first vibrator 211. By means of the cooperation of the first vibrator 211 and the second vibrator 212, it is conductive to the balanced and consistent sound pressure level of the frequency response curve of the vibrator apparatus 200.

In addition, in the example of the present disclosure, the areas of the bonding faces 213 of all the second vibrators 212 are identical or different, which needs to be designed according to actual situations and is not specifically limited in the present disclosure.

Figure 5:
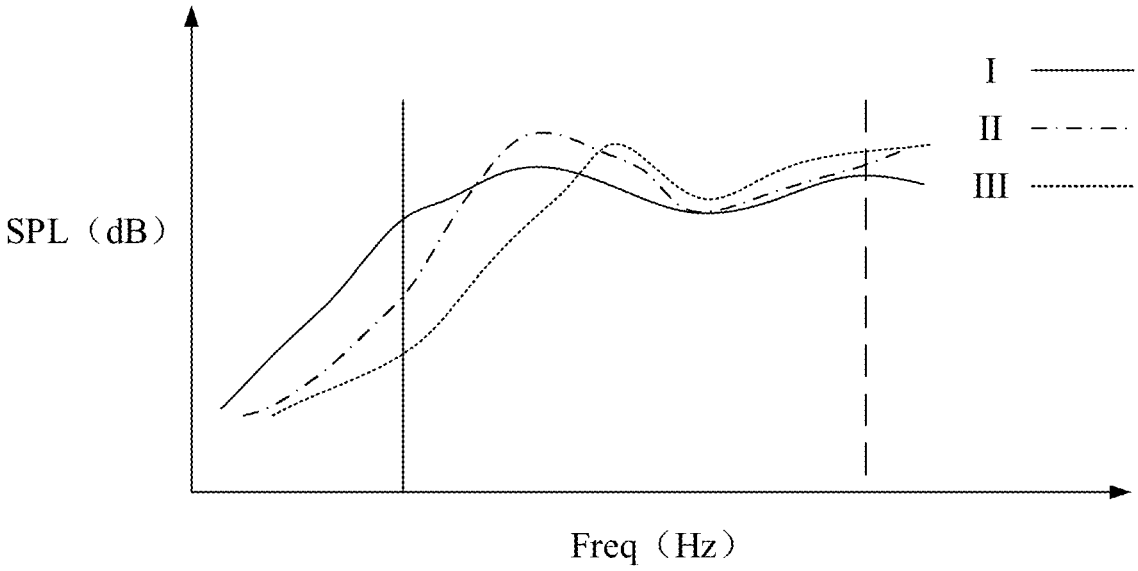
FIG. 5 illustrates a schematic view of frequency response curves of three vibrators arranged at different positions according to an illustrative example of the present disclosure.

FIG. 5 illustrates a schematic view of frequency response curves of three vibrators 210 arranged at different positions according to an illustrative example of the present disclosure. In FIG. 5, a horizontal axis (Freq) represents a frequency, and the frequency increases gradually along a direction to which an arrow of the horizontal axis points. A longitudinal axis (SPL) represents a sound pressure level, and the sound pressure level increases gradually along a direction to which an arrow of the longitudinal axis points. A frequency corresponding to a solid straight line is less than a frequency corresponding to a dotted straight line. Three frequency response curves I, II, III are the frequency response curves of Vibrator 4, Vibrator 5, and Vibrator 6, respectively. Vibrator 4, Vibrator 5, and Vibrator 6 have the same structure and dimension, while the Vibrator 4 is arranged in middle of the body 100, Vibrator 5 is arranged at an edge of the body 100, and Vibrator 6 is arranged at a corner of the body 100. As illustrated in FIG. 5, at the solid straight line (i.e. at a relatively low frequency), the sound pressure level of the frequency response curve I>the sound pressure level of the frequency response curve II>the sound pressure level of the frequency response curve III. With the increase of the frequency, the sound pressure levels of the frequency response curves I, II, III first decrease and then increase. At the dotted straight line (i.e. at a relatively high frequency), the sound pressure level of the frequency response curve I<the sound pressure level of the frequency response curve II<the sound pressure level of the frequency response curve III. As can be seen, the closer the vibrator 210 is to the middle of the body 100, the better the low frequency performance of the frequency response curve is, and the closer the vibrator 210 is to the edge or the corner of the body 100, the better the high frequency performance of the frequency response curve is.

In some examples, the second vibrator 212 is arranged closer to the edge or the corner of the body 100 than the first vibrator 211. In some examples, according to the influence of the arrangement position of the vibrator 210 on the frequency response curve, the low frequency performance of the frequency response curve of the first vibrator 211 is better than the low frequency performance of the frequency response curve of the second vibrator 212, and the high frequency performance of the frequency response curve of the second vibrator 212 is better than the high frequency performance of the frequency response curve of the first vibrator 211. Moreover, the area of the bonding face 213 of the first vibrator 211 is larger than the area of the bonding face 213 of the second vibrator 212, such that the first vibrator 211 takes full advantages of its low frequency performance and the second vibrator 212 takes full advantages of its high frequency performance, which is conductive to that the vibrator apparatus 200 has the balanced and consistent frequency response curve.

In some examples, at least two second vibrators 212 are provided, and the at least two second vibrators 212 are arranged to be centered at a center of gravity of the first vibrator 211. In some examples, the at least two second vibrators 212 are arranged based on the center of gravity of the first vibrator 211, which is conductive to the effective cooperation between the first vibrator 211 and the second vibrator 212 so as to form the balanced and consistent frequency response curve.

Figure 6:
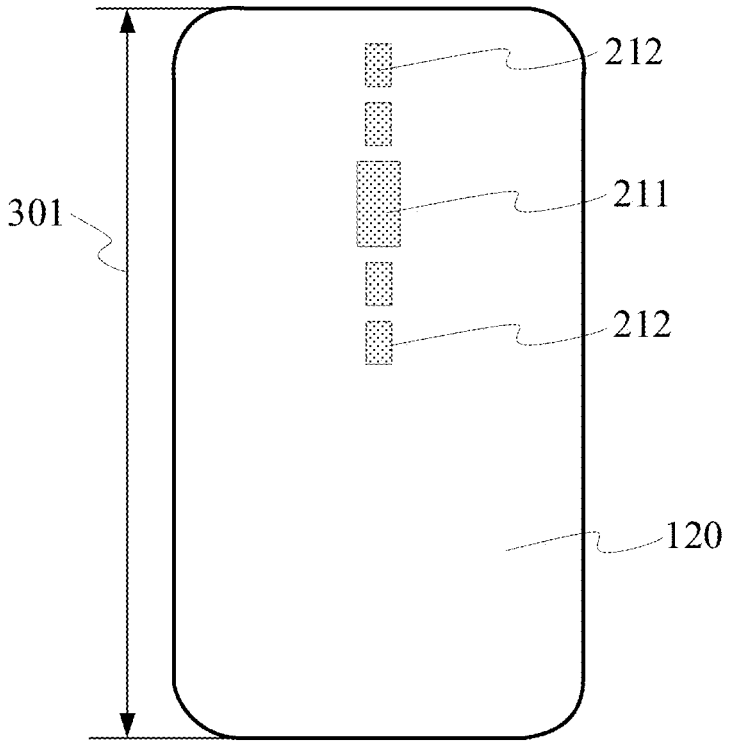
FIG. 6 illustrates a schematic view of an arrangement of a vibrator apparatus according to an illustrative example of the present disclosure.
Figure 7:
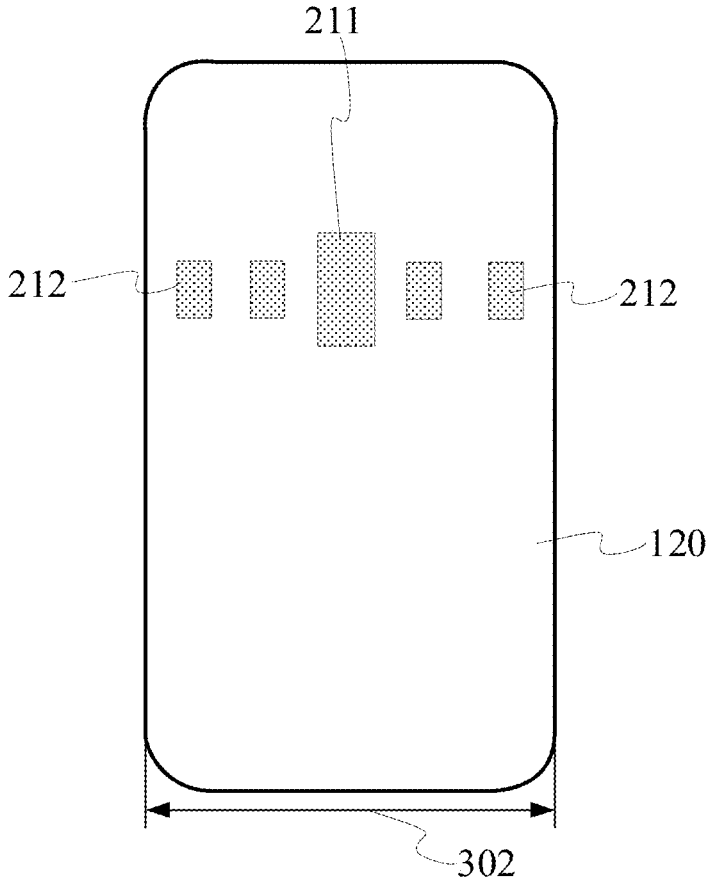
FIG. 7 illustrates a schematic view of an arrangement of a vibrator apparatus according to an illustrative example of the present disclosure.
Figure 8:
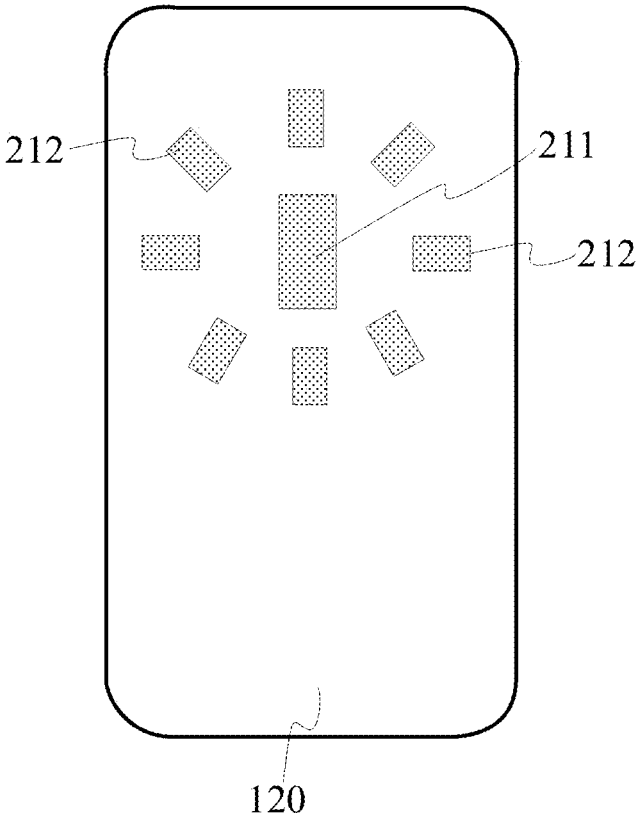
FIG. 8 illustrates a schematic view of an arrangement of a vibrator apparatus according to an illustrative example of the present disclosure.
Figure 9:
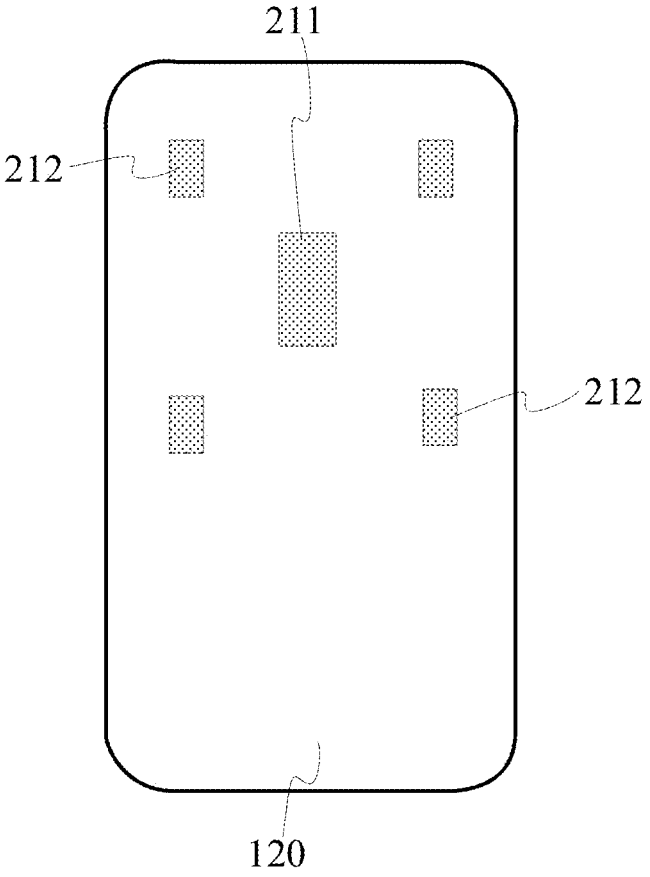
FIG. 9 illustrates a schematic view of an arrangement of a vibrator apparatus according to an illustrative example of the present disclosure.

FIG. 6 illustrates a schematic view of an arrangement of the vibrator apparatus 200 according to an illustrative example of the present disclosure. FIG. 7 illustrates a schematic view of an arrangement of the vibrator apparatus 200 according to an illustrative example of the present disclosure. FIG. 8 illustrates a schematic view of an arrangement of the vibrator apparatus 200 according to an illustrative example of the present disclosure. FIG. 9 illustrates a schematic view of an arrangement of the vibrator apparatus 200 according to an illustrative example of the present disclosure. The present disclosure gives following examples for the arrangement of the vibrator apparatus 200 with reference to FIGS. 6 to 9.

In some examples, the at least two second vibrators 212 are arranged in one of a straight line form (as illustrated in FIG. 6 or 7), a circular form (as illustrated in FIG. 8), or a polygonal form (as illustrated in FIG. 9).

Based on the requirements for the frequency response curve, the occupied space and the power consumption of the vibrator apparatus 200, the at least two second vibrators 212 may be arranged in one or more straight lines. In some examples, as illustrated in FIG. 6, the at least two second vibrators 212 are arranged on both sides of the first vibrator 211 in the straight line form along a length direction 301 of the body 100. In this way, the sound generated from the vibrator apparatus 200 has good directivity along the length direction 301, and thus a sound output hole in this direction can be replaced. Additionally, this arrangement is simple and is conductive to improving the production efficiency of the electronic device.

In other examples, as illustrated in FIG. 7, the at least two second vibrators 212 are arranged on both sides of the first vibrator 211 in the straight line form along a width direction 302 of the body 100. In this way, the sound generated from the vibrator apparatus 200 has good directivity along the width direction 302, and thus a sound output hole in this direction can be replaced. Additionally, this arrangement is simple and is conductive to improving the production efficiency of the electronic device.

In addition, a plurality of second vibrators 212 may be arranged around the first vibrator 211 in a form of a plurality of concentric circles. The plurality of second vibrators 212 may also be arranged around the first vibrator 211 in a form of a plurality of concentric polygons. Arrangement directions of the plurality of second vibrators 212 may be consistent, or may be staggered to form a structure similar to a flower.

In addition, the at least two second vibrators 212 and the first vibrator 211 may also be arranged in other regular or irregular forms, which is not specifically limited in the present disclosure.

Figure 10:
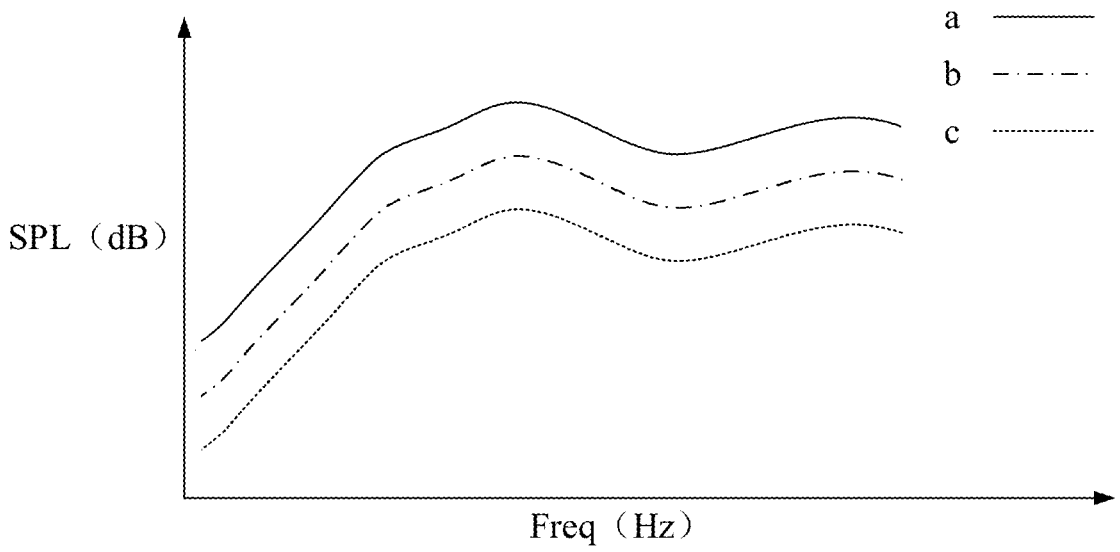
FIG. 10 illustrates a schematic view of frequency response curves of three vibrators with different thicknesses according to an illustrative example of the present disclosure.

FIG. 10 illustrates a schematic view of frequency response curves of three vibrators 210 with different thicknesses according to an illustrative example of the present disclosure. In FIG. 10, a horizontal axis (Freq) represents a frequency, and the frequency increases gradually along a direction to which an arrow of the horizontal axis points. A longitudinal axis (SPL) represents the sound pressure level, and the sound pressure level increases gradually along a direction to which an arrow of the longitudinal axis points. Three frequency response curves a, b, c are the frequency response curves of Vibrator 7, Vibrator 8, and Vibrator 9, respectively. Vibrator 7, Vibrator 8 and Vibrator 9 have the same structure and the same area of the bonding face 213, while the thickness of Vibrator 7>the thickness of Vibrator 8>the thickness of Vibrator 9. It can be seen from FIG. 10 that, the sound pressure level of the frequency response curve a>the sound pressure level of the frequency response curve b>the sound pressure level of the frequency response curve c, and shapes of the frequency response curves a, b, c are identical. As can be seen, the larger the thickness of the vibrator 210 is, the larger the sound pressure level of the frequency response curve is, and the smaller the thickness of the vibrator 210 is, the smaller the sound pressure level of the frequency response curve is.

In some examples, the thickness of the first vibrator 211 is larger than the thickness of the second vibrator 212. In some examples, according to the influence of the thickness on the frequency response curve, by configuring the thickness of the first vibrator 211 to be larger than the thickness of the second vibrator 212, the sound pressure level of the frequency response curve of the first vibrator 211 is improved. The cooperation between the first vibrator 211 and the second vibrator 212 makes the sound pressure level of the frequency response curve balanced and consistent, such that the electronic device has a good sound quality. Moreover, the space at the edge or the corner of the body 100 is usually small, which is conductive to the cooperation between the first vibrator 211 and the second vibrator 212 to effectively occupy the space in the body 100. The thicknesses of the first vibrator 211 and the second vibrator 212 needs to be set according to the internal space of the body 100, the power consumption and the frequency response curve of the vibrator apparatus 200, which is not specifically limited in the present disclosure.

In some examples, the bonding face 213 of the vibrator 210 has a long strip shape. Compared with a square of the same area, the frequency response curve of the vibrator 210 whose bonding face 213 has the long strip shape has a better performance.

In some examples, further as illustrated in FIG. 2, the at least two vibrators 210 include the vibrator 210 with a single-layer structure and/or the vibrator 210 with a multi-layer structure. In some examples, for the vibrators 210 with the same thickness, the more the layers of the vibrator 210 are, the better the performance of the frequency response curve of the vibrator 210 is. By means of the at least two vibrators 210 including the vibrator 210 with the single-layer structure and/or the vibrator 210 with the multi-layer structure, in conjunction with other factors such as the thickness, the area and the shape of the bonding face 213 or the like, it is further conductive to the balanced and consistent performance of the frequency response curve of the vibrator apparatus 200.

In some examples, the smaller the volume of the vibrator 210 is, the less the power consumption of the vibrator 210 is. That is, the smaller the area of the bonding face 213 and/or the thickness is, the less the power consumption of the vibrator 210 is. Since the at least two vibrators 210 have at least one of the different thicknesses and the different areas of the bonding faces 213, the volumes of the at least two vibrators 210 are different, which provides more possibilities for flexible arrangements. Compared with a plurality of identical vibrators 210, the vibrator apparatus 200 provided in the present disclosure can flexibly adjust the thickness of the vibrator 210, the area of the bonding face 213 and the number of the vibrators 210, which is conducive to reducing the power consumption.

To sum up, when the vibrator apparatus 200 is applied, at least one of the area and shape of the bonding face 213, the thickness, the position, the number, and the structure layer number of the vibrator 210 can be flexibly adjusted in conjunction with the internal space of the body 100 of the electronic device, such that the vibrator apparatus 200 satisfies requirements of the balanced and consistent frequency response curve, the small occupied space, and the little power consumption, or the like, thus achieving the purposes of being used flexibly, saving the space, and saving the power consumption, which is conductive to the high integration, the miniaturized volume, the full screen of the electronic device and the holeless electronic device.

The above examples of the present disclosure may be complementary for each other under the case of no conflict.

The above description is only a preferable example of the present disclosure, which is not construed to limit the present disclosure. Any modification, equivalent replacement, improvement made within the spirit and principle of the present disclosure should be included in the protection scope of the present disclosure.

What is claimed is:

1. A vibrator apparatus for an electronic device, comprising:

a plurality of vibrators, wherein the vibrator apparatus is fixed in a body of the electronic device, the plurality of vibrators are separately disposed in the body and configured to vibrate to generate sound, and each of the plurality of vibrators comprises a bonding face configured to be bonded to the body, wherein two or more vibrators of the plurality of vibrators have at least one of following different qualities: thicknesses, areas of the bonding face, or shapes of the bonding face, wherein thickness of each of the plurality of vibrators is measured along a direction perpendicular to the bonding face, and wherein the plurality of vibrators comprise a first vibrator and a plurality of second vibrators disposed around a center of gravity of the first vibrator, the first vibrator and the plurality of second vibrators are separately disposed, and area of a first bonding face of the first vibrator is larger than area of a second bonding face of each second vibrator.

2. The vibrator apparatus according to claim 1, wherein the plurality of second vibrators are disposed closer to an edge or a corner of the body than the first vibrator is.

3. The vibrator apparatus according to claim 1, wherein the plurality of second vibrators are disposed in one of a straight line form, a circular form, or a polygonal form.

4. The vibrator apparatus according to claim 3, wherein the plurality of second vibrators are disposed on both sides of the first vibrator in the straight line form along a length direction of the body.

5. The vibrator apparatus according to claim 3, wherein the plurality of second vibrators are disposed on both sides of the first vibrator in the straight line form along a width direction of the body.

6. The vibrator apparatus according to claim 1, wherein thickness of the first vibrator is larger than thickness of the second vibrator.

7. The vibrator apparatus according to claim 1, wherein the plurality of vibrators comprise at least one of following: a vibrator with a single-layer structure or a vibrator with a multi-layer structure.

8. The vibrator apparatus according to claim 1, wherein the plurality of vibrators comprise at least one of a piezoelectric film or a piezoelectric ceramic.

9. The vibrator apparatus according to claim 1, further comprising:

an adhesive layer disposed on the bonding face, wherein the adhesive layer is configured to connect the bonding face to the body.

10. The vibrator apparatus according to claim 1, further comprising:

a flexible printed circuit board, wherein the flexible printed circuit board is connected with the plurality of vibrators at a face opposite to the bonding face.

11. An electronic device, comprising:

a body; and a vibrator apparatus fixed in the body, wherein the vibrator apparatus comprises a plurality of vibrators separately disposed in the body and configured to vibrate to generate sound, and each of the plurality of vibrators comprises a bonding face configured to be bonded to the body, wherein two or more vibrators of the plurality of vibrators have at least one of following different qualities: thicknesses, areas of the bonding face or shapes of the bonding face, wherein thickness of each of the plurality of vibrators is measured along a direction perpendicular to the bonding face, and wherein the plurality of vibrators comprise a first vibrator and a plurality of second vibrators disposed around a center of gravity of the first vibrator, the first vibrator and the plurality of second vibrators are separately disposed, and area of a first bonding face of the first vibrator is larger than area of a second bonding face of each second vibrator.

12. The electronic device according to claim 11, wherein the body comprises a housing, a screen display disposed on a front face of the housing, and a space between the housing and the screen display, wherein the vibrator apparatus is mounted in the space.

13. The electronic device according to claim 12, wherein the plurality of vibrators of the vibrator apparatus are bonded to a face of the screen display facing the housing.

14. The electronic device according to claim 12, wherein the plurality of vibrators of the vibrator apparatus are bonded to a face of the housing facing the screen display.

15. The electronic device according to claim 13, wherein a shielding layer is disposed on the face of the display screen facing the housing, and the plurality of vibrators are bonded to a face of the shielding layer facing away from the display screen.

16. The electronic device according to claim 11, further comprising:

a controller connected with the vibrator apparatus, wherein the controller is configured to control vibration of two or more vibrators of the plurality of vibrators of the vibrator apparatus.

17. The electronic device according to claim 11, further comprising:

a controller connected with the vibrator apparatus, wherein the controller is configured to control the plurality of vibrators of the vibrator apparatus to vibrate under at least one driving voltage.

18. The electronic device according to claim 11, further comprising:

a controller connected with the vibrator apparatus, wherein the controller is configured to control vibration of two or more vibrators of the plurality of vibrators of the vibrator apparatus, and further to control each of the plurality of vibrators of the vibrator apparatus to vibrate under at least one driving voltage.

* * * * *